US008627590B1

(12) United States Patent
Whitehead

(10) Patent No.: US 8,627,590 B1
(45) Date of Patent: Jan. 14, 2014

(54) FRAME ASSEMBLY

(71) Applicant: James D. Whitehead, Beverly Hills, MI (US)

(72) Inventor: James D. Whitehead, Beverly Hills, MI (US)

(73) Assignee: James D. Whitehead, Beverly Hills, MI (US)

( * ) Notice: Subject to any disclaimer, the term of this patent is extended or adjusted under 35 U.S.C. 154(b) by 0 days.

(21) Appl. No.: 13/746,396

(22) Filed: Jan. 22, 2013

(51) Int. Cl.
*D06C 3/08* (2006.01)
*G09F 17/00* (2006.01)

(52) U.S. Cl.
USPC ..... 40/792; 40/732; 38/102.91; 160/395; 160/397

(58) Field of Classification Search
USPC ..... 40/732, 790, 792, 603, 604; 38/102.91; 160/395, 397
See application file for complete search history.

(56) References Cited

U.S. PATENT DOCUMENTS 2,489,477 A 11/1949 Brecher
3,678,607 A * 7/1972 Tabor et al. ..... 38/102.91
4,124,323 A 11/1978 Freeman
4,233,765 A * 11/1980 O'Mullan et al. ..... 40/792
6,976,326 B2 * 12/2005 Tajima et al. ..... 38/102.91

OTHER PUBLICATIONS

Declaration of James Whitehead dated Jan. 18, 2013.

* cited by examiner

*Primary Examiner* — Casandra Davis
(74) *Attorney, Agent, or Firm* — Carlson, Gaskey & Olds P.C.

(57) ABSTRACT

Disclosed is a frame assembly including a framing member and an extrusion member. The frame assembly further includes a sheet having a graphic thereon. The sheet includes a gasket at a perimeter thereof, and the gasket is positioned in a channel of the extrusion member such that the channel supports the sheet.

17 Claims, 4 Drawing Sheets

FIG.2

FRAME ASSEMBLY

BACKGROUND

This disclosure relates to a frame assembly that may be used to display various items, including a graphic printed on a fabric sheet, as one example.

Frames of various sizes, including relatively large frames, are typically used by businesses, such as automotive dealerships, to display advertisements for certain products, or to decorate showrooms, as examples. Depending on the size of the particular frame, professional setup and installation of the frame may be required.

SUMMARY

A frame assembly for displaying a graphic according to a non-limiting embodiment of the present disclosure includes a framing member made of a first material having a rabbet provided by a first rabbet surface facing a rear of the framing member, and a second rabbet surface facing perpendicular to the first rabbet surface. The rabbet has a width provided from an inner edge of the framing member to the second rabbet surface, and a depth provided from a rear of the framing member to the first rabbet surface.

The frame assembly further includes an extrusion member of a second material that is different from the first material. The extrusion member has a channel and a rabbet engagement portion. The rabbet engagement portion has an upper wall and a lower wall, an upper surface of the upper wall being in contact with the first rabbet surface, and a lower surface of the lower wall being flush with the rear edge of the framing member.

The frame assembly further includes a sheet having a graphic thereon. The sheet includes a gasket at a perimeter thereof, and the gasket is positioned in the channel of the extrusion member such that the channel supports the sheet.

As will be appreciated from the below, this disclosure can be used to provide an off-the-shelf framing member with an extrusion specifically adapted to a rabbet of that particular framing member, and thus allow the framing member to be used within a new type of frame assembly.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1:
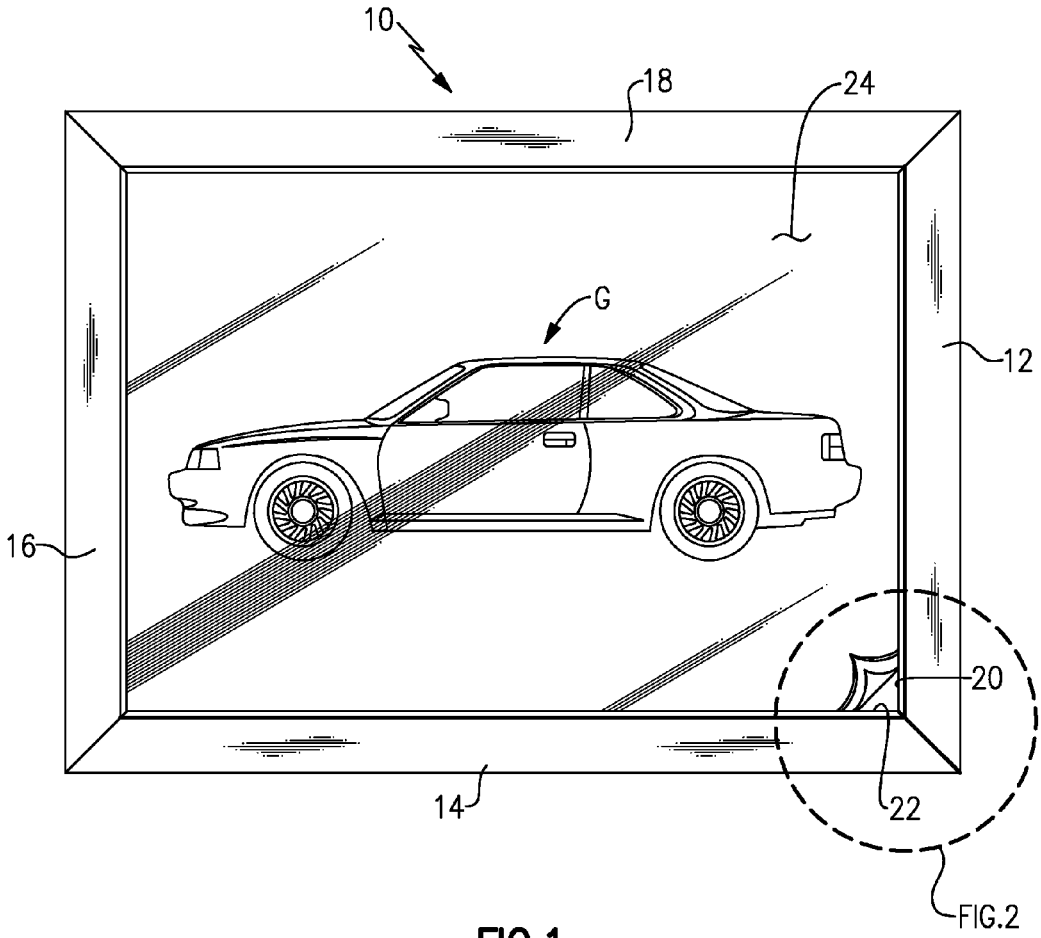
FIG. 1 illustrates a frame assembly according to the present disclosure.

FIG. 1 is a representative view of the disclosed frame assembly 10. As illustrated, the frame assembly includes framing members 12, 14, 16, 18. Each of the framing members 12, 14, 16, 18 is associated with a respective extrusion member, only two of which are visible (e.g., extrusion members 20, 22) in FIG. 1. In one example of this disclosure, the framing members 12, 14, 16, 18 are made of wood, and the extrusion members 20, 22 are made of a metal, such as aluminum. While wood and aluminum are specifically contemplated by this disclosure, this disclosure extends to other material types. Further, while four framing members 12, 14, 16, 18 are illustrated, this disclosure extends to frame assemblies that include any number of framing members (e.g., triangular frames).

As discussed above, the frame assembly 10 can be used to display various graphic images G. In one example, the seller of the frame assembly 10 would also sell various sheets 24, each having a different graphic image G thereon. In this example, the sheet 24 includes a polymer gasket 26 arranged at a perimeter thereof. The polymer gasket 26 can be received in a channel 28 of the extrusion members 20, 22 as generally illustrated in FIG. 2.

Figure 2:
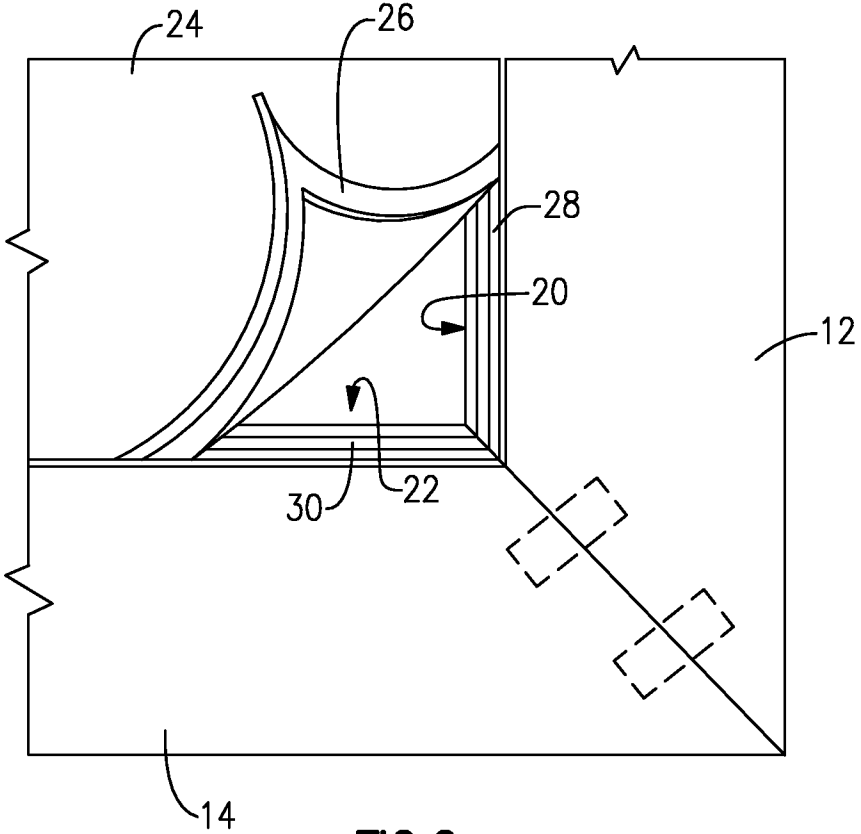
FIG. 2 illustrates detail of the area encircled in FIG. 1.

FIG. 2 illustrates the detail of the encircled area of the frame assembly 10, from FIG. 1. When assembled, the frame assembly 10 provides channels 28, 30 within each of the respective extrusion members 20, 22. Each of the framing members 12, 14, 16, 18 would support a respective extrusion member 20, 22, and when the frame assembly is arranged as shown in FIG. 1, a continuous channel would be provided about the framing assembly. The gasket 26 of the sheet 24 is sized to fit within the channels 28, 30, such that the sheet would then be supported by the engagement of the polymer gasket 26 with the channels. The nature of the interaction between the polymer gasket 26 and the metal channels 28, 30 provides for an effective support for the sheet, while further allowing a user the ability to relatively easily change the sheets 24, depending on whether the user desires to portray a different graphic image G.

Figure 3:
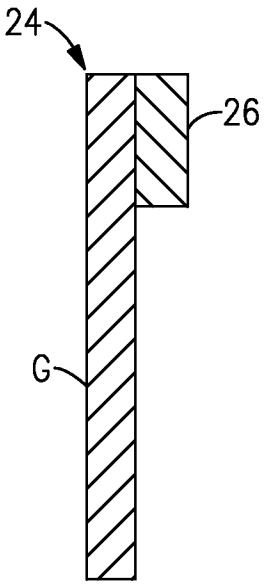
FIG. 3 illustrates a cross-sectional view of the sheet and gasket.

FIG. 3 is a side view illustrating the detail of the sheet 24, which may be a nylon fabric or another type of elastic material, and the manner in which the gasket 26 is arranged at the perimeter of the sheet 24. The gasket 26 could be selected from a polymer material that provides a desired interaction between the gasket in 26 and the channels 28, 30.

Figure 5:
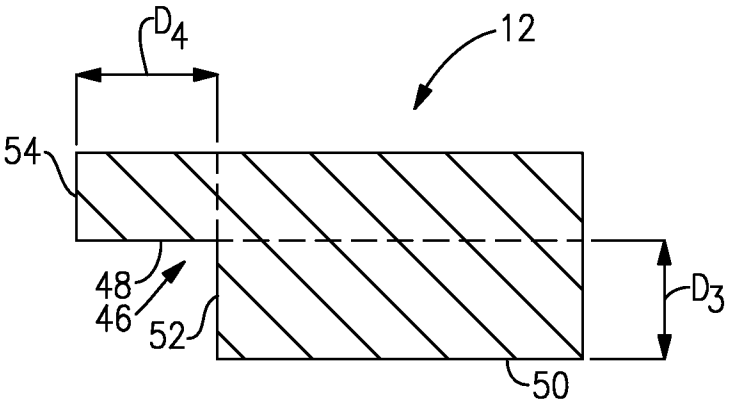
FIG. 5 illustrates a cross-sectional view of a framing member.
Figure 6:
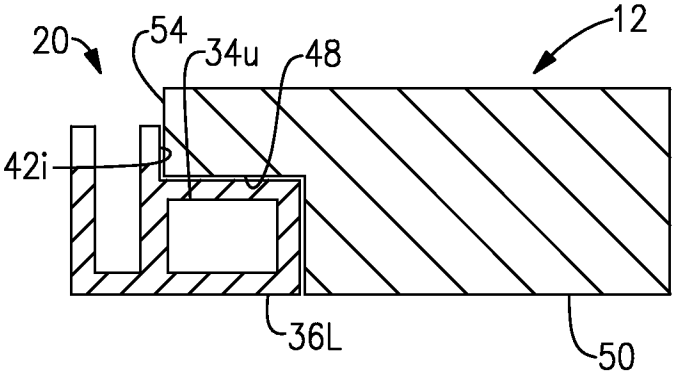
FIG. 6 illustrates an example of the manner in which the extrusion member is arranged relative to the framing member.
Figure 4:
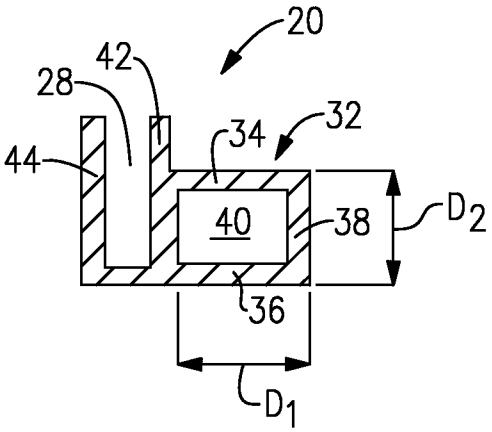
FIG. 4 illustrates a cross-sectional view of an extrusion member.

Turning to FIGS. 4-6, detail of the extrusion and framing members is shown. In FIG. 4, the extrusion member 20 is illustrated. The extrusion member 20 includes a channel 28 and a rabbet engagement portion 32. The rabbet engagement portion 32 includes upper and lower walls 34, 36 respectively. The rabbet engagement portion 32 further includes a vertical wall 38 between the upper and lower walls 34, 36. In this example, there is a hollow space 40 between the upper, lower and vertical walls to save material. The channel 28 is provided between an inner channel wall 42 and an outer channel wall 44. For purposes of explanation later, the upper and lower walls, 34, 36 each have a length D1, and the vertical wall 38 has a length D2.

A framing member 12 is illustrated in FIG. 5. The framing member 12 includes a rabbet, or notch, 46 generally at an inner and rear edge thereof. The rabbet 46 includes a first rabbet surface 48 facing a rear 50 of the framing member 12, and a second rabbet surface 52 facing perpendicular to the first rabbet surface 48 and toward an inner edge 54 of the framing member 12. The rabbet is provided with a depth D3 between the rear edge 50 of the framing member 12 and the first rabbet surface 48, and a width D4 provided between an inner edge 54 of the framing member 12 and the second rabbet surface 52.

Depending on the selected framing member 12, the rabbet 46 will be of different dimensions. In an example of this disclosure, the dimensions of the extrusion member 20 are selected such that the extrusion member 20 fits with the framing member 12 in an acceptable manner. This allows for easy assembly, reducing the time and expense typically required to retrofit an existing extrusion with a framing member.

For example, as illustrated in FIG. 6, the extrusion member 20 is sized such that an upper surface 34U of the upper wall 34 is in contact with the first rabbet surface 48. Further, the lower surface 36L is sized such that the lower surface 36L is substantially flush with the rear edge 50 of the framing member 12. As used herein, the term "substantially" means "within dimensional tolerances accepted in the art." Further, an inner surface 421 is in contact with the inner edge 54 of the framing member 12. This engagement between the framing member 12 and the extrusion member 20 provides a sturdy support that is easily assembled, again, without any need to retrofit the extrusion member to the sides of the rabbet 46.

Figure 8:
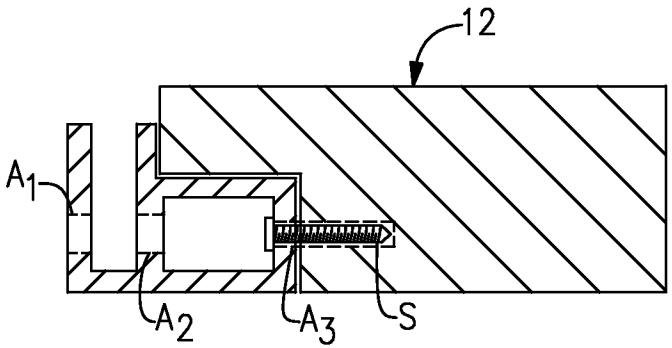
FIG. 8 illustrates the detail of the encircled area in FIG. 7.
Figure 7:
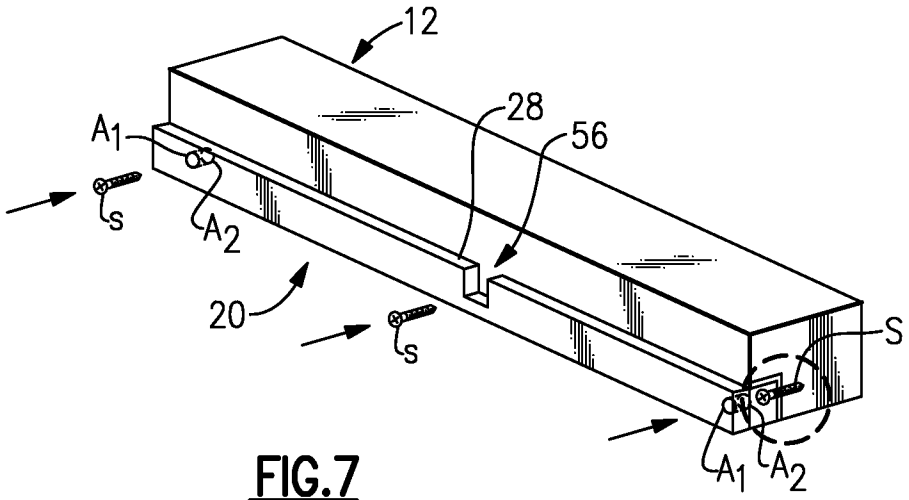
FIG. 7 illustrates examples of the manner in which the framing member is fastened to the extrusion member.

FIG. 7 illustrates example manners for engaging the framing member 12 with the extrusion member 20. As illustrated, the extrusion member 20 could be provided with a plurality of apertures A1, A2 in the outer channel wall 44 and the inner channel wall 42, respectively. As illustrated in FIG. 8, there is also an aperture A3 formed within the vertical wall 38 of the rabbet engagement portion 32. As illustrated, these apertures A1-A3 are in axial alignment with one another such that a fastening element, such as a screw S, can be screwed from left to right (relative to FIG. 8) into the framing member 12, and in particular is screwed into the second rabbet surface 52. Turning back to FIG. 7, the channel 28 could be provided with a plurality of slots 56 which would generally serve the same purpose as the apertures A1-A3.

As would be understood by those in the art, the terms rear, inner, outer, front, upper and lower, are used relative to the normal attitude of the framing assembly 10 as it would be arranged on a wall, for example. The term "rear," for example, generally refers to a side facing the wall, and the term "inner" generally refers to the interior of the framing assembly, such as the area near the graphic element G in FIG. 1.

Although the different examples have the specific components shown in the illustrations, embodiments of this invention are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A frame assembly for displaying a graphic, comprising:

a framing member of a first material, the framing member having a rabbet provided by a first rabbet surface facing a rear of the framing member and a second rabbet surface facing perpendicular to the first rabbet surface, the rabbet having width and a depth, the width provided from an inner edge of the framing member to the second rabbet surface, and the depth provided from a rear edge of the framing member to the first rabbet surface;

an extrusion member of a second material different from the first material, the extrusion member having a channel and a rabbet engagement portion, the rabbet engagement portion having an upper wall and a lower wall, an upper surface of the upper wall in contact with the first rabbet surface, and a lower surface of the lower wall being substantially flush with the rear edge of the framing member; and a sheet having a graphic thereon, the sheet having a gasket at a perimeter thereof, the gasket positioned in the channel such that the channel supports the sheet.

2. The frame assembly as recited in claim 1, wherein the rabbet engagement portion includes a vertical wall extending between the upper wall and the lower wall, an outer surface of the vertical wall in contact with the second rabbet surface.

3. The frame assembly as recited in claim 2, wherein a length of the vertical wall is substantially equal to the depth of the rabbet.

4. The frame assembly as recited in claim 2, wherein the extrusion member includes an aperture in the vertical wall, and wherein a fastening element is provided through the aperture and into the second rabbet surface to engage the extrusion member with the framing member.

5. The frame assembly as recited in claim 4, wherein the extrusion member further includes apertures in an outer channel wall and an inner channel wall, the apertures in the outer channel wall, the inner channel wall, and the vertical wall being aligned to allow the fastening element to be provided into the second rabbet surface.

6. The frame assembly as recited in claim 4, wherein the fastening element is a screw.

7. The frame assembly as recited in claim 1, wherein the channel is provided by an inner channel wall and an outer channel wall, the inner channel wall extending between the upper wall and the lower wall, an outer surface of the outer channel wall in contact with the inner edge of the framing member.

8. The frame assembly as recited in claim 1, wherein lengths of the upper wall and the lower wall are substantially equal to the width of the rabbet.

9. The frame assembly as recited in claim 1, including four framing members, each of the framing members associated with a respective extrusion member.

10. The frame assembly as recited in claim 1, including a plurality of fastening elements to connect the framing members to one another to provide a rectangular-shaped frame assembly.

11. The frame assembly as recited in claim 1, wherein the gasket is made of a polymer material.

12. The frame assembly as recited in claim 11, wherein the gasket is provided on a rear surface of the sheet.

13. The frame assembly as recited in claim 1, wherein the first material is wood.

14. The frame assembly as recited in claim 1, wherein the second material is a metal.

15. The frame assembly as recited in claim 14, wherein the second material is aluminum.

16. The frame assembly as recited in claim 1, wherein the sheet is made of an elastomeric material.

17. A frame assembly for displaying a graphic, comprising:

four wood framing members, the framing members each having a rabbet provided by a first rabbet surface facing a rear of the framing member and a second rabbet surface facing perpendicular to the first rabbet surface, the rabbets each having width and a depth, the width provided from an inner edge of the associated framing member to the second rabbet surface, and the depth provided from a rear edge of the associated framing member to the first rabbet surface;

four aluminum extrusion members, each of the extrusion members supported by a respective one of the framing members, the extrusion members each having a channel and a rabbet engagement portion, the rabbet engagement portions each having an upper wall and a lower wall, an upper surface of each of the upper walls in contact with an the first rabbet surface of an associated frame member, and a lower surface of each of the lower walls being substantially flush with the rear edge of an associated wood framing member, each of the channels provided by an inner channel wall and an outer channel wall, the inner channel walls extending between the upper wall and the lower wall of the respective extrusion member, an outer surface of each of the outer channel walls being in contact with the inner edge of the framing member;

four fastening elements connecting the four framing elements together; and an elastomeric sheet having a graphic thereon, the sheet having a polymer gasket at a perimeter thereof, the gasket provided on a rear surface of the sheet, the gasket positioned in the channels such that the channels support the sheet.

* * * * *